United States Patent [19]

Humphrey

[11] Patent Number: 4,911,461

[45] Date of Patent: Mar. 27, 1990

[54] DOWNHILL SKIS INCORPORATING INTEGRAL PROBE ASSEMBLY FOR CONTROLLING SPEED AND MANEUVERABILITY

[75] Inventor: John M. Humphrey, Monte Sereno, Calif.

[73] Assignee: Humphrey Engineering, Inc., Monte Sereno, Calif.

[21] Appl. No.: 318,738

[22] Filed: Mar. 3, 1989

[51] Int. Cl.[4] ..... A63C 7/10

[52] U.S. Cl. ..... 280/605; 188/5

[58] Field of Search ..... 280/601, 604, 605, 608, 280/809, 606; 188/5, 6, 7, 8

[56] References Cited

U.S. PATENT DOCUMENTS

| | | | |
|---|---|---|---|
| 3,048,418 | 8/1962 | Gertsch | 280/605 |
| 3,195,911 | 7/1965 | Cubberley | 280/605 |
| 3,295,859 | 1/1967 | Perry | 280/601 |
| 3,873,108 | 3/1975 | Lacarrau et al. | 280/605 |
| 3,909,024 | 9/1975 | Salomon | 280/605 |
| 3,918,730 | 11/1975 | Schultes | 280/605 |
| 3,980,322 | 9/1976 | Schultes | 280/605 |
| 4,062,561 | 12/1977 | Altenburger | 280/605 |
| 4,103,916 | 8/1978 | Krob et al. | 280/605 |
| 4,152,007 | 5/1979 | Smith | 280/605 |
| 4,219,214 | 8/1980 | Kostov | 280/605 |
| 4,227,708 | 10/1980 | Cote | 280/809 |
| 4,227,714 | 10/1980 | Riedel | 280/605 |
| 4,312,517 | 1/1982 | Spademan | 280/605 |
| 4,795,183 | 1/1989 | Reuters | 280/605 |

FOREIGN PATENT DOCUMENTS

| | | | |
|---|---|---|---|
| 14420 | 8/1903 | Austria | 280/604 |
| 187456 | 2/1937 | China | 280/605 |
| 650475 | 9/1937 | Fed. Rep. of Germany | 280/604 |
| 3543829 | 6/1987 | Fed. Rep. of Germany | 280/605 |
| 736916 | 12/1932 | France | 280/605 |
| 816949 | 8/1937 | France | 280/605 |
| 433183 | 4/1948 | Italy | 280/604 |

*Primary Examiner*—Charles A. marmor
*Assistant Examiner*—Michael Mar
*Attorney, Agent, or Firm*—John J. Leavitt

[57] ABSTRACT

Presented is a method and apparatus that permits a skier to control the speed at which he descends a ski slope. In terms of structure, the invention includes an integral probe assembly including a pair of probes mounted on each ski at about the center of gravity that protrude below the running surface of the ski when deployed and thereby drag in the snow. The probes may be controlled as to the depth of penetration of the snow either before the skier starts the downhill run, or during descent. The skier may also retract the probes so as eliminate the control and maneuverability that they provide. Having deployed the probes, added maneuverability control is achieved merely by conventional body movements which affect the depth to which the probes penetrate the snow. The probe assembly may be incorporated in the skis during manufacture of the skis, or may be added to the skis subsequent to manufacture.

7 Claims, 3 Drawing Sheets

DOWNHILL SKIS INCORPORATING INTEGRAL PROBE ASSEMBLY FOR CONTROLLING SPEED AND MANEUVERABILITY

BACKGROUND OF THE INVENTION

1. Field of the Invention

This invention relates to skis and downhill snow skiing, and more particularly to downhill skis incorporating an integral probe assembly that enables a skier to achieve enhanced maneuverability and improved speed control in the activity of downhill snow skiing.

2. Description of the Prior Art

This application is related in subject matter to my copending application Ser. No. 07/126,211.

A review of the prior art has convinced me that the embodiments of the invention disclosed and claimed in my referenced copending application, and the subject matter of the instant invention are the only method and apparatus which:

(a) provide a downhill skier with enhanced control over both axial drag and lateral maneuverability using localized control probes; and (b) provide both of the above enhancements by selective use of the skier's natural body movements transmitted to the skis per se and without additional mechanical connection to the skier.

A search of the prior art has revealed the existence of the following U.S. Pat. Nos.:

| | | |
|---|---|---|
| 3,980,322 | 3,918,730 | 3,909,024 |
| 3,195,911 | 3,048,418 | 4,152,007 |
| 4,103,916 | 4,062,561 | 4,227,708 |
| 3,873,108 | 4,312,517 | 4,227,714 |

Additionally, the following references have been cited in copending application Ser. No. 07/126,211: U.S. Pat. No. 3,295,859; Austrian Patent No. 14,420; French Patent Nos. 816,949; 736,916; Italian Patent No. 433,183, Switzerland Patent No. 187,456, and German Patent Nos. 650,475 and 3,543,829.

At the outset, it is well to understand that the invention forming the subject matter of this specification does not concern the problem of stopping a loose ski that has become separated from a skier, nor does this invention relate to cross-country type skis equipped with devices to prevent back sliding when climbing a slope or to brake devices intended primarily to bring the skier to a halt. Rather, this invention focuses on the problem of imposing additional controlling forces on the skis while actively being used in a downhill skiing activity or "run" in such a way that the skier will still proceed downhill but will feel more in control of the skis at the speed at which he chooses to descend.

Referring to the patents listed above, all of the United States patents except U.S. Pat. Nos. 3,295,859; 4,152,007 and 4,227,708 relate to the situation where a ski has been separated from a skier and is loose on the ski slope and apt to cause some damage or injury to skiers unless stopped. These "loose ski" brake devices do not operate during active skiing, and are clearly unrelated to the structure and function of the invention described herein.

U.S. Pat. No. 3,295,859 merely discloses parallel longitudinal grooves or channels formed in the running surface of the ski adjacent to, but inboard of each side edge to provide a pronounced V-shaped edge. These function merely like sharper edges applying load along the entire length of the ski rather than as local control probes applying loads at a specific location along the ski.

U.S. Pat. No. 4,152,007 provides snow plows at the rear ends of the skis that are activated by hydraulic pressure controlled through the grips on the ski poles. Obviously, there must be some connection between the grips on the ski poles and the snow plows and this in itself is a disadvantage in that the skier is prevented from utilizing the ski poles as freely as he might for the purpose for which they are intended. This device provides active drag control, which is the only function it shares with my invention described herein. The characteristics of this device are in sharp contrast with the enhanced maneuverability provided by my invention. Because the plows in this device are at the rear ends of the skis and therefore far behind the skier's center of gravity, they actually tend to prevent the skier from turning while they are engaged. The hydraulic actuation is also significantly different than the normal skiing motions that are effective to control the maneuverability characteristics of my invention. Therefore, this device is clearly functionally and structurally different from my method and apparatus.

U.S. Pat. No. 4,227,708 relates to a ski brake that comprises a plate fixed on the upper surface of the ski. The plate is provided with a notch into which the lower end of the ski pole may be inserted to produce drag against the snow. While the primary purpose of this device is to provide traction in cross-country skiing, it purports to provide active braking for a cross-country skier moving downhill. Active braking is also one of the at least three important functions of my apparatus. However, this device does not provide either the enhanced maneuverability or control by natural body motions provided by my apparatus. Maneuverability is an essential difference between downhill skiing and cross-country skiing. The bindings of cross-country skis naturally limit maneuverability. Since this device applies drag only on the outside of the skis, downhill braking would tend to spread the tips of the skis, making the skis even more difficult to maneuver. Use of the ski poles as braking levers violates the natural motions of downhill skiing which requires upper body movement and free use of the poles. Therefore, this device, while obviously structurally different from my apparatus in all its embodiments, is also clearly incapable of performing two of at least three major functions performed by my skis incorporating integral probe assemblies.

Referring to the foreign patents listed above, Austrian Patent No. 14,420 appears to be a crampon type device to be used by cross-country skiers when "walking" up slopes and the need arises to prevent back-sliding of the skis.

French Patent No. 816,949 discloses the concept of a brake for downhill skiing, but the brake mechanisms of at least two of the embodiments require a harness to be worn by the skier, with a tether extending between the harness and the brake mechanism. In these embodiments, the brake mechanism is activated by a "loaded" spring when the skier squats, and is deactivated by tension on the tether to again load the spring when the skier straightens up. In a third embodiment, the brake mechanism is normally deactivated by a loaded spring, and activated by the skier depressing the mechanism with a ski pole against the deactivating force exerted by the spring. This patent also discloses two different types of crampon devices useful for climbing slopes without backsliding. This device, located behind the skier's center of gravity, only claims to be useful for straight ski braking and does not provide the enhanced maneuvering capability of the instant invention.

German Patent No. 650,475, Italian Patent No. 433,183 and Switzerland Patent No. 187,456 appear to be directed solely to crampon type devices useful for climbing snow-laden slopes as in cross-country skiing. None of the structures illustrated and described by these patents appears useful for controlling speed and maneuverability in downhill skiing.

Lastly, German Patent No. 3,543,829 discloses a brake device which requires activation by continuous engagement of a ski pole so long as the brake is applied. The ski poles may thus not be used for their intended purpose while being used to activate the brake. Disengagement of the ski pole from the activating lever of the brake mechanism appears to automatically deactivate the brake. This device does not address the use of localized forces near the skier's center of gravity to achieve enhanced maneuverability.

For those that are experienced skiers, it will be obvious that skiing on a steep slope requires considerably more physical effort and skill than skiing on a gentle slope. Turning maneuvers to reduce speed require the skier to generate a force in opposition to the force tending to propel the skier downhill. This force, multiplied by the skier's velocity, equates with the power the skier must exert to maintain speed control on the slope. Steeper slopes require both a greater maximum force and a greater average power which together require greater strength and endurance from the skiers. First, since they have a higher ability threshold, a greater fraction of the potential energy during the run is consumed in aerodynamic and ski drag. Second, since they are more skillful, they are able to make turns with less muscle strain. Although expert skiers still must exert the same force as less experienced skiers, they apply it more effectively in reducing speed.

As stated above, the primary purpose of my method and integral probe assembly is to enhance the safe enjoyment of downhill skiing by significantly reducing the level of skill and physical strength required to participate in the sport.

The method and integral probe assembly or apparatus of my invention enables a skier to safely handle terrain that would otherwise be beyond his ability. It is believed that wide spread use of my method and apparatus will increase the number of individuals participating in downhill skiing and will reduce the number of injuries sustained by such participants when they are inadvertently caught in situations beyond their ability.

The sport of downhill skiing involves executing trained physical body motions that change the skier's pacial orientation and weight distribution as the skis slide across the snow. The maneuvers that result from such body motions enable the skier to control his direction and most importantly his speed.

In this sport of downhill skiing, the skier converts potential energy into mechanical work and ultimately into heat. By the conservation of energy, the rate of change of potential energy equals the rate of change of kinetic energy plus the rate of mechanical work performed by the skier. This mechanical work rate (or power) is the skier's velocity multiplied by the snow friction and air drag. Steeper slopes require a greater friction plus drag force to hold a given speed than more gentle slopes.

A skier's strength and skiing ability determine the steepness of the slope that he can comfortably and safely handle. Skiing skill determines how efficiently a skier can convert muscle force into useful drag. The snow-plow or wedge is a perfect example of an inefficient skiing maneuver. In the wedge maneuver, the skier pushes outward on his skis and thereby creates an axial force equal to his lateral force multiplied by the sine of the angle of his skis. Since the "V" half angle of his skis is typically only about 15 degrees or less only one quarter of his lateral force is converted into useful drag. This situation is compounded by the awkward nature of the snow-plow or wedge maneuver.

Proficient skiers have several advantages over beginning skiers. First, they can ski at a higher average speed letting ski friction and aerodynamic drag (which are relatively non-fatiguing) generate mechanical work at a faster rate. Second, they can convert muscle force more efficiently into useful drag. A good parallel skier can seemingly effortlessly make small turns and efficiently use his leg muscles to react the drag force needed to keep his speed under control. Third, the proficient skier is often in better physical condition and has greater strength and endurance than beginning skiers.

Enjoyable skiing is a process of speed control. If a skier is not in excellent condition, and he is unable to efficiently convert his muscle forces into drag, he will either be limited to gentle and uninteresting terrain or, more typically, he will ski on terrain beyond his ability and risk injury to himself and others. Unfortunately, our modern society neither encourages physical fitness nor provides extended leisure time to learn new activities. This results in millions of people who would like to enjoy downhill skiing, but have not found the time to become advanced intermediate skiers where they can really begin to enjoy the sport. Accordingly, a method and apparatus such as described herein is needed to reduce the level of skill required to enjoy downhill skiing by permitting skiers to more efficiently convert muscle force into speed control and maneuverability while retaining the natural motions of skiing.

Another element enters into the method of speed control and has been alluded to somewhat above. That is the fact that conventionally speed control is effected by manipulating turns on the slope to introduce a force that is in opposition to the downhill acceleration force that is imposed by gravity and the steepness of the slope. Accordingly, if some method or means could be devised by which turns could be effected without the imposition of discomfort on the skier or the utilization of excessive muscle force, then the skier would be more likely to attempt a run on a steep slope that he would not otherwise feel comfortable with.

Accordingly, one of the important objects of the present invention is to provide a method and means by which a skier may selectively control maneuverability and therefore speed on a downhill ski slope.

The invention achieves selective maneuverability and speed control by adding localized selectively deployable and adjustable fluid dynamic control surfaces on downhill skis to enhance both axial drag and maneuverability using a skier's natural motions. These additional control surfaces generate forces that augment the edge control forces on the skis. The control surfaces of my invention, referred to herein as "probes", are analogous to the spoiler/flap system on modern jet airplanes in terms of vehicle drag and stability characteristics. Since snow produces loads only below the running surface of the ski, another object of my invention is the provision of a method and apparatus allowing for differentially varying probe depth on the inside and outside edges of the skis.

The following discussion illustrates how the probes of my invention enhance the speed and maneuverability control characteristics of snow skis. The detailed description of the structures (including the probes) that provide these characteristics is presented later in this disclosure. That description also presents features of the structures which facilitate the operation of the invention but which do not directly affect the speed and maneuverability control aspects discussed below.

Accordingly, a still further object of the invention is the provision of apparatus which, in the engaged or operative position, extends two probes on each ski a precise distance below the running surface of the ski and into the snow. These probes act as additional control surfaces that augment the forces acting on the other ski surfaces during downhill skiing.

A still further object of the invention is the provision of apparatus in conjunction with snow skis which when engaged and operative, has the effect of making a slope appear to be more gentle, and which includes probes which project below the running surface of the ski to provide additional drag which controls the skier's acceleration and terminal velocity.

Still another object of the invention is the provision of apparatus for snow skis, including projecting probes, which can be adjusted either before or during a run so as to adjust the basic drag coefficient by adjusting the depth of the probe's extension below the running surface of the skis.

Although these steady drag effects are important, the primary additive drag effects occur as a result of skier controlled probe depth variation during the ski run. Tests have shown that the drag imposed on a ski by a probe projecting into the snow is a strong function of probe depth. Accordingly, a still further object of the invention is the provision of an apparatus including pairs of probes attached to the skis in such a manner that rotating the ski about the longitudinal axis increases the penetration depth on one probe and decreases the penetration depth of the other probe on that ski. This differential probe depth causes a significant increase in the total drag, because of the large increase in drag on the deeper probe. This has two primary applications in downhill skiing speed control as will now be explained. The wedge maneuver becomes far more effective and less strenuous to execute. Simply rotating the knees together (with the skis pointed straight) produces a large drag increase due to the greater penetration of the inside probes. The differential torque created by the drag on the inside probes automatically draws the ski tips together, adding the normal snow-plow edge drag, but without the muscle strain normally required. Rotating the knees back to vertical returns the skis to normal parallel position and equalizes the forces on the skis, cancelling the differential torque.

Parallel turns are more effective in achieving speed reduction when the skis are equipped with my probe system. The edge drag is supplemented by probe drag. Effective speed control can be accomplished with very little edge drag which is quite helpful under poor snow conditions.

Turning ability, which is a major factor in maneuverability, is significantly enhanced because the probes enable turning by leaning. For example, leaning to the right increases the penetration depth and drag on the right probes on both skis and decreases the depth and drag on the left probes. This both increases the total drag and creates a rotational moment that turns the skis to the right. Similarly, leaning to the left turns the skier to the left. As discussed below, the skier can further enhance turning ability by leaning slightly backward as he leans to the left or right.

Tests have shown that my invention permits a skier to maintain speed and maneuverability control on icy slopes without edge control. The method used to accomplish this is as follows: While skiing downhill, the skier first leans slightly to the right (or left) allowing the greater probe drag on that side to rotate the skis. When the angle of the skis with the slope reaches 30 to 60 degrees, the skier leans slightly forward and notices his rotation stops when the longitudinal location of his center of gravity is slightly forward of the location of the probes. Rotational equilibrium is achieved because the torque of the probes about the center line of the ski acting to rotate the skis uphill is balanced by the torque of the probe forces about the skier's center of gravity acting to rotate the skis downhill.

The skier can now independently control his speed and orientation. The skier can lean further to the right (or left) to reduce his speed or even stop completely or, reduce his lean to accelerate while maintaining the angle of his skis to the slope. While executing these speed control maneuvers, the skier can rotate his skis by controlling the longitudinal location of his center of gravity. Leaning slightly forward rotates the skis downhill by increasing the moment arm between the probe forces and the skier's center of gravity. Similarly, leaning slightly backward causes the skis to rotate uphill. Using the probes, these motions, which are easily mastered, restore speed and maneuverability control under icy conditions which are difficult to handle with standard skis.

The method and apparatus of my invention provides "trim" adjustment to reduce muscle strain associated with holding the skis together. Most people walk with their feet slightly spread apart and their muscles are adjusted to that position. Therefore, parallel skiing requires a constant muscle strain to hold the tips of the skis together. With my method and apparatus, a skier can alleviate this condition by adjusting the depth of penetration of the inside probes to be slightly greater than the depth of penetration of the outside probes. This creates a toe-in moment on the skis which keeps the tips together without continuous muscle strain by the skier.

The following discussion relates to the features of my invention which, taken individually or in combination, account for the speed control and maneuverability enhancement characteristics discussed above:

1. Precise depth control.—Since drag is a strong function of depth, the probes of my invention are designed to provide precise setting and control of their extension past the running surface of the skis.

2. Probe center of pressure location.—Probe location near the skier's center of gravity is necessary to provide the desired neutral lateral stability characteristics. Locating the probes aft of the skier's center of gravity (i.e., a positive stability margin as in the classic loose ski brake) would make turning more difficult because the probes would produce a restoring moment tending to keep the skis pointed in the direction of travel. Locating the probes forward of the center of gravity (i.e. negative stability margin) would make the skis rotationally unstable.

Tests have shown that the middle of the toe piece is a good longitudinal location for the probes. This appears to be the natural location of the skier's center of gravity when he is leaning slightly forward as on moderate slopes. Obviously, the exact optimum location of the probes depends on the skier's ability and the terrain. The subject invention provides flexibility in longitudinal probe location to accommodate individual skiing needs. As discussed earlier, the skier can control his center of gravity location and thereby control the stability characteristics of his skis. By leaning forward (and moving his center of gravity forward of the probes) the probes act to keep the skis pointed in the direction of travel and stabilize any lateral oscillations. By leaning backward during turning, the skier can enhance turning by moving the center of gravity slightly aft of the probes and making the skis deliberately unstable. The skier would obviously do this after he had started a turn and had both his skis clearly rotated in one direction.

3. Two-pin characteristics.—Many of the desirable characteristics of my method and apparatus require two pins (one on each side of the ski). A single pin configuration locates the pin under the toe piece and provides a steady drag and facilitates turning by the center of gravity shift mechanism discussed above. However, the two pin design adds the ability to increase drag by leaning as in parallel turns or by rotating the knees together, as in a snow-plow maneuver. The turning-by-leaning feature requires a two pin arrangement; the turning-by-aft-center-of-gravity-shift only starts to work after the skis have rotated relative to the direction of travel.

4. Probe lift/drag characteristics.—The shape and orientation of the probes are important in establishing the operating characteristics of the method and apparatus of my invention. While I have illustrated and described herein probes which constitute cylindrical rods which present arcuate surfaces to the snow, it is apparent that other configurations may be utilized within the spirit and scope of the invention. As indicated above, the preferred probe configurations shown in the embodiment illustrated are all cylindrical. This axisymmetric shape is an advantage because it provides the facility to provide for threaded probe-depth adjustment. However, the probes are not restricted to axisymmetric shapes. Shapes such as ellipsis, wedges, airfoils or other profiles offer potential advantages under certain conditions and are intended to be covered within the scope of this invention.

With respect to orientation of the pins, vertical pins produce no lift, and this is an advantage for the beginning skier. Rotating the skis about their longitudinal axis to produce differential drag does not require any force to overcome lift. This is an advantage for the snow-plow maneuver, but less important for the turning-by-leaning maneuver. Vertical pins provide higher drag (and slower speeds) under poor snow conditions.

Probe cant provides a means to achieve non-axisymmetric drag forces with cylindrical probes. Probe cant reduces the drag coefficient parallel to the skis without significantly changing the drag coefficient perpendicular to the skis. A canted cylindrical probe will behave similar to a wedge or airfoil-shaped probe with less steady state drag but about the same side force. Therefore, vertical probes which enhance wedge maneuvers are preferable for beginning skiers and slightly canted probes which reduce steady drag effects are preferable for more advanced skiers. The subject invention can be configured to encompass the full range of cant angles.

An unexpected benefit is derived by the use of my method and apparatus that relates to the condition of a ski slope. Conventionally, ski slopes are used during daylight hours and are "groomed" during the night or early morning to prepare them for another full day of skiing. I have found that because the control forces applied to the skis by the probes are relatively small and because packed snow is a viscous fluid, probe depth of only ¼ to ½ inch appear to be adequate for most conditions. I have found that penetration of the snow by the probes creates a hardly perceptible groove in the snow. Tests have shown that the almost imperceptible grooves left by the probes are almost invisible and quickly disappear in normal packed-powder snow. I have also found that these tiny grooves appear to help groom the slopes under high packed or moderately icy snow conditions. When the snow becomes icy, edge control becomes difficult because the edge loading is insufficient to cause penetration of the snow by the ski edge. This is also true for the probes under severely icy conditions, the probes easily penetrate the snow surface. This feature gives the skiers significantly improved control under these conditions while the probes help break up the hard ice surface. Accordingly, if enough skiers use the probe system of my invention, it is easy to see that their combined actions would help prevent hard or icy layers from forming on the slopes.

In my copending applicaiton Ser. No. 07/126,211, the structures illustrated and described were designed for application to existing skis without modification or intrusion into the ski structure per se. Those structures are therefore believed to be particularly attractive to ski binding manufacturers as new products saleable with their ski bindings. Accordingly, it is an object of the present invention to provide an "integral" probe assembly that may be applied by the ski manufacturer at the time the skis are fabricated, or retrofitted to skis after manufacture.

The invention possesses other objects and featutes of advantage, some of which with the foregoing will be apparent from the following description and the drawings. However, it is to be understood that the invention is not limited to the embodiments illustrated and described, since it may be embodied in various forms within the scope of the appended claims.

SUMMARY OF THE INVENTION

In terms of broad inclusion, there is presented a ski and probe assembly either manufactured with the ski or mounted on the ski after manufacture. The probe assembly adds control surfaces which the skier may manipulate to control the amount and direction of application of auxiliary control forces imposed on the skis during a downhill ski run. Manipulation of auxiliary control forces is achieved through natural skier motions during the run. The sensitivity of the auxiliary control forces to skier motions can be varied by manual adjustment of the probes by the skier before or while stopped during a run, and through automatic adjustments by the probe assembly in response to snow conditions. Geometry adjustments may include depth variation on each probe, cant variation, probe replacement, probe location changes and probe disengagement. Automatic adjustments include load relief for vaying snow conditions or contact with solid objects, such as rocks beneath the snow.

In the aspect of the invention wherein the probe assembly is incorporated in the skis by the ski manufacturer at the time of manufacture, the invention broadly comprises a support member embedded in each ski and adapted to pivotally support a cam block from which laterally extend axle rods that project from the opposite side edges of each ski. A probe is adjustably mounted on each projecting end portion of the axle rods, and are susceptible to being pivoted from an inactive position out of engagement with the snow when the skis are in use, to an active or operational position in which the probes project a predetermined distance below the running surface of the ski. A spring-pressed detent is provided cooperating with the pivotal cam block to retain the cam block and axle rods, and therefore the probes, in a selected position.

In the second aspect of the invention, the probe assembly is again "integral" with the skis, but is structured to be applied to the skis after manufacture rather than during manufacture. In this embodiment of the invention, parallel support plates are fixed to opposite edges of the ski and are joined by a pair of axle rods that pass transversely through the skis. One rod forms a bearing on which are pivotally supported adjacent opposite side edges of the skis mounting blocks on which are adjustably mounted metal probes adapted to be selectively pivoted between active and inactive positions. In the active position, the probes project a predetermined distance beyond the lower or running surface of the skis when the skis are in use. When in inactive position, the probes are retained above the running surface of the ski and therefore do not come in contact with the snow when the skis are in use. Means are provided mounted on the support plates and interacting with the mounting blocks for retaining the probes in a selected active or inactive position. Means are also provided for adjusting the extent of pivotal displacement of the probe support blocks to thereby control the cant angle of the probes in relation to the running surface of the ski. Thus, in both aspects of the invention probe depth may be adjusted prior to skiing by either extending the probes, or by adjusting their cant.

DESCRIPTION OF THE PREFERRED EMBODIMENT

Figure 1:
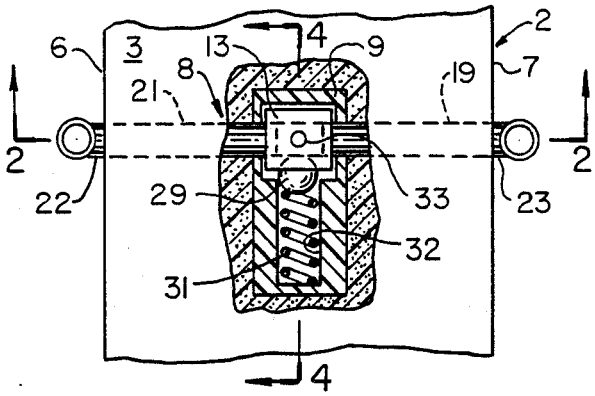
FIG. 1 is a fragmentary plan view of a ski equipped with the preferred embodiment of the invention wherein the probe assembly is incorporated in the ski by the ski manufacturer at the time the ski is fabricated. Portions of the ski structure are broken away to reveal underlying parts, some of which parts are shown in elevation and some in cross-section for clarity.

The method and means described and illustrated herein enhances the safe enjoyment of downhill skiing by significantly reducing the level of skill and physical strength required to participate in the sport. Thus, it is expected that this invention will augment the numbers of individuals participating in the sport, and will serve to diminish the number of injuries sustained by such participants resulting from such particupants being inadvertently caught in a dangerous situation beyond the threshold of their ability. The method and means described and illustrated herein places at the disposal of the skier means for enhanced control over both drag and maneuverability.

Referring to FIGS. 1 through 7 inclusive, there is there shown in top plan view a fragmentary portion of a snow ski 2 having a top surface 3, a bottom surface 4 and left and right side edges 6 and 7, respectively. The surface 3 of the ski consititutes the skier support surface, while the under surface 4 of the ski constitutes the "running" surface of the ski that is in contact with the snow while the ski is in use.

Mounted on the ski is an adjustable probe assembly designated generally by the numeral 8 and including a support member 9 embedded in the body 12 of filler material that lies laminated between the top surface 3 and the bottom surface 4, both of which surfaces are conventionally fabricated from an appropriate aluminum alloy. The body of filler material 12 may conveniently be formed from balsa wood or from an appropriate rigid synthetic foam material while the lateral side edges 6 and 7 are formed by an appropriate synthetic material sealed to the mutually facing edge surface portions of the aluminum alloy top and bottom surface members 3 and 4, thus sealing the interior of the ski structure to prevent the migration of moisture thereinto.

The support member 9, being embedded in the body of filler material 12, lies immovable therein, and serves as an adequate support base 4 a generally cylindrical cam block 13 rotatable about a transverse axis that extends generally perpendicular to the longitudinal dimension of the ski. The cam block 13 is provided with a generally cylindrical outer periphery that is in turn provided with a pair of circumferentially spaced recesses 14 and 16 shown in FIGS. 1 and 4. The cylindrical cam block 13 is mounted in association with the inner mutually overlapping semi-cylindrical end portions 17 and 18 of laterally projecting axle members 19 and 21, respectively, that extend transversely through the interior body of filler material and project laterally beyond the side edges 6 and 7 of the ski in exterior portions 22 and 23. As shown, the exterior end portions 22 and 23 of the rotatable and axially aligned transversely extending axles 19 and 21 serve to mount, respectively, tubular probe holders 24 and 26, the interior peripheries of which are appropriately threaded to threadably receive adjustable probe members 27 and 28.

Figure 2:
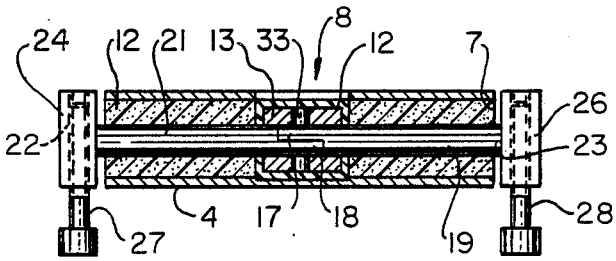
FIG. 2 is a vertical cross-sectional view taken in the plane indicated by the line 2—2 in FIG. 1, showing the probe assembly in active position.
Figure 3:
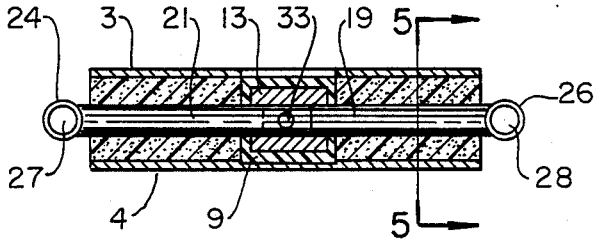
FIG. 3 is a vertical cross-sectional view similar to FIG. 2, but showing the probe assembly pivoted to inactive position.
Figure 7:
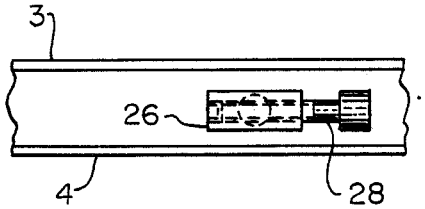
FIG. 7 is a fragmentary elevational view showing the probe assembly in retracted inactive position.

It will thus be seen that the probe holders 24 and 26, with adjustable probes 27 and 28 threadably secured therein, may be rotated from an active position as illustrated in FIG. 2, wherein the probes 27 and 28 extend a predetermined and adjustable distance below the running surface 4 of the ski, so as to project into the snow and thereby provide a measurable amount of drag on the ski. It will be seen that the probe holders 24 and 26 with attendant probes 27 and 28 may be pivoted into an inactive position as illustrated in FIG. 7, by pivotal rotation of the axle members 19 and 21 so that the longitudinal axis of the probe holders 24 and 26 and the attendant probes 27 and 28 lie substantially parallel to the longitudinal axis of the ski 2 as illustrated in FIG. 7.

To retain the probe assembly in its adjusted position, the probe assembly includes a spring-pressed detent arrangement including a spherical ball 29 (FIGS. 1 and 2) resiliently pressed against the outer periphery of the cam block 13 by a coil compression spring 31 as shown. The coil compression spring 31 lies in a bore 32 formed axially in the support member 9 as shown, and cooperates with the spherical ball 29 and the recesses 14 and 16 formed in the periphery of the cam block 13 to retain the cam block in one or the other of the positions to which it is shifted by rotation of the probe holders 24 and 26 as previously discussed. To retain the axle portions 19 and 21 from longitudinal displacement relative to one another, the overlapped semi-cylindrical portions 17 and 18 are fixedly joined by an appropriate pin 33 as shown in FIGS. 1 and 2.

It will thus be seen that the cam block 13, cooperating with the detent ball 29 and compression spring 31 controls the rotational orientation of the probe holders 24 and 26 and through them the probes 27 and 28. These elements provide probe drag load control to maintain a smooth ride under varying snow conditions. When the drag exceeds a preset value, the cam begins to rotate, which reduces probe drag to maintain equilibrium. As soon as the drag decreases, the mechanism returns to the fully engaged position illustrated in FIG. 2. The cam also provides a stable disengaged position. This position can be reached either by manual disengagement of the probe and probe holders as will hereinafter be explained, or by safety disengagement due to a sufficiently high force such as contact with a solid object lying in the snow and struck by one of the probes whereby a rotational moment will be applied to the probe assembly to cause full retraction of the probe assembly.

Figure 8:
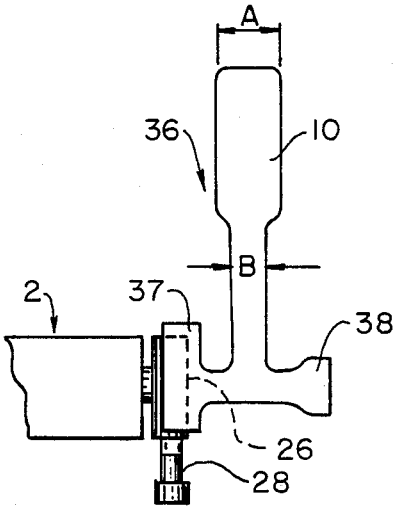
FIG. 8 is an elevational view illustrating a tool in operative association with the probe assembly to effect pivotal displacement of the probe assembly from operative position to inoperative position or vise versa.
Figure 4:
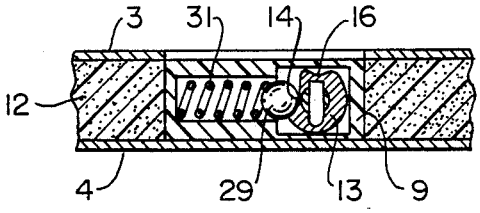
FIG. 4 is a fragmentary horizontal cross-sectional view taken in the plane indicated by the line 4—4 in FIG. 1.
Figure 5:
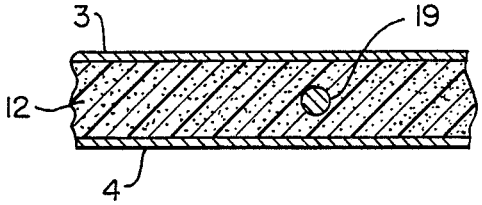
FIG. 5 is a fragmentary vertical cross-sectional view taken in the plane indicated by the line 5—5 in FIG. 3.
Figure 6:
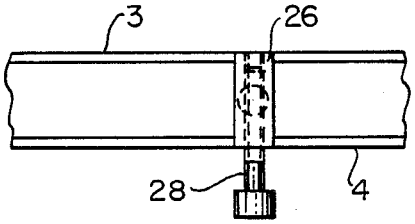
FIG. 6 is a fragmentary elevational view showing the probe assembly deployed in active position.
Figure 9:
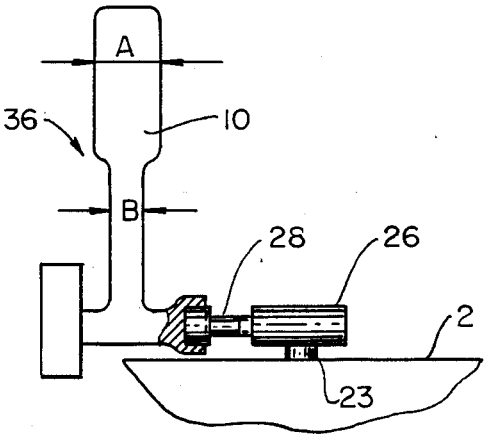
FIG. 9 is an elevational view illustrating use of the tool to effect a depth adjustment of the probe.

For this embodiment of the invention, a manual engagement and depth control adjustment tool is provided designated generally by the numeral 36 and illustrated in FIGS. 8 and 9. The tool 36 facilitates field adjustments of the probe assembly, and comprises a handle 10, and a probe holder engagement member 37 constituting a semi-cylindrical socket adapted to slip snugly over the generally cylindrical exterior periphery of the probe holders 24 and 26 as shown in FIG. 8. All that is required to readjust the position of the probe holders and probes is to turn the tool through approximately a 90 degree angle to shift the spherical ball 29 from one detent recess 14 to the other detent recess 16.

When used to adjust the depth of penetration of the probes 27 and 28 in the snow, the tool 36 is provided with a generally cylindrical socket member 38 recessed as shown in FIG. 9 to receive the head of a probe whereby appropriate rotational movement of the tool about the axis of the probe holder and probe will cause the probe to be adjusted in relation to the probe holder so as to project more or less below the lower running surface 4 of the ski. Since in most instances, both of the probes 27 and 28 will be adjusted so that both probes project equally from their respective probe holders, it will be noted that the handle 10 of the tool is provided with a section having a width A that corresponds generally to the maximum desirable extension of the probe, while the more narrow neck portion of the handle designated by the dimension B, correlates to the minimum depth adjustment of the probe. Obviously, the probes may be adjusted beyond these minimum and maximum ranges, and may be done so accurately for comparison purposes between the two probes by counting the number of rotations applied to each probe. Since the pitch of the threads which provide adjustable engagement between the probes and the probe holders is the same on both probes, obviously, a 360 degree rotation of the probes will advance or retract them by equal increments.

Figure 10:
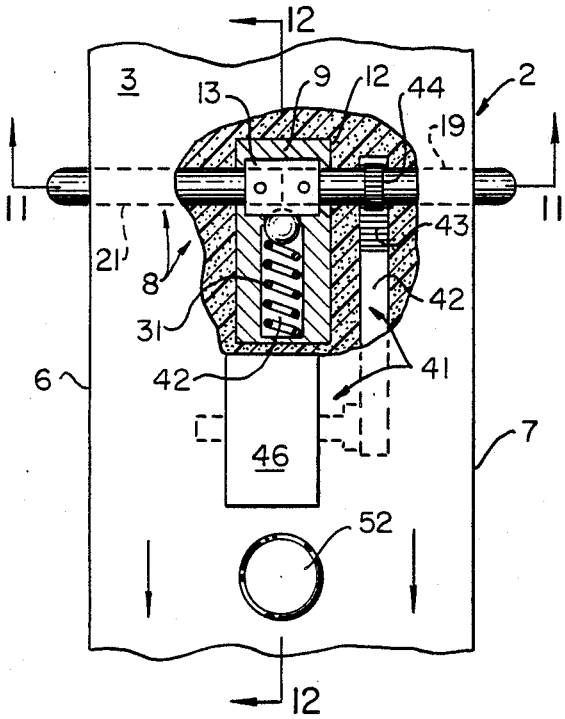
FIG. 10 is a fragmentary plan view similar to FIG. 1 illustrating the integral probe assembly of FIG. 1 equipped with a probe actuating assembly mounted on the ski and manipulable by the skier by hand or by use of a ski pole. A portion of the structure is broken away to reveal underlying parts.
Figure 12:
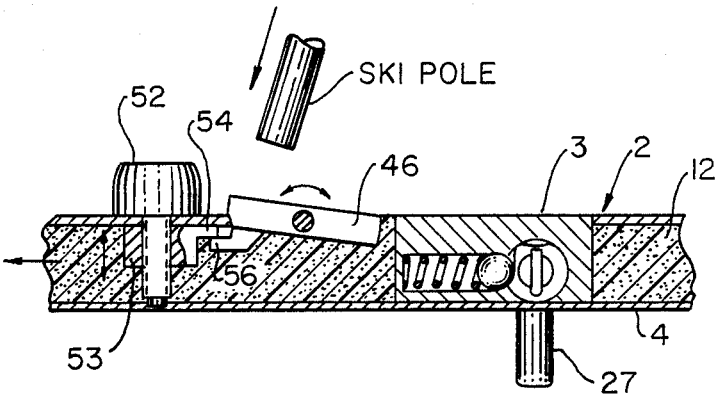
FIG. 12 is a fragmentary vertical cross-sectional view taken in the plane indicated by the line 12—12 in FIG. 10.
Figure 11:
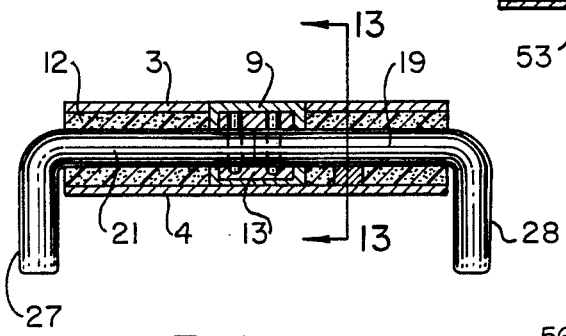
FIG. 11 is a vertical cross-sectional view taken in the plane indicated by the line 11—11 in FIG. 10.
Figure 13:
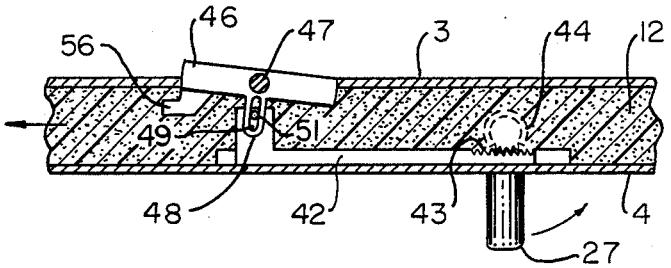
FIG. 13 is a fragmentary vertical cross-sectional view taken in the plane.

In some instances it is advantageous if the skier has the facility for activating or deactivating or adjusting the depth of penetration of the probes while he is engaged in a downhill run. For that purpose, the structure illustrated in FIGS. 10 through 14 fulfills that need. Referring to FIG. 10, it will be seen that there has been added to the embodiment of the invention illustrated in FIG. 1, a probe assembly actuating apparatus designated generally by the numeral 41 and including an elongated rack member 42 slidably disposed within an appropriate slot formed in the body of filler material 12 and having a plurality of teeth 43 adapted to engage complementary teeth 44 formed on the periphery of one of the axles 19 or 21, here shown to be formed on the axle 19. It will thus be seen that as the rack 42 is slid backwardly or forwardly, rotation of the axle 19 occurs and the degree of that rotation is controlled in the manner previously discussed in connection with the operation of the detent ball 29 and the detent recesses 14 and 16. To effect sliding motion of the rack 42, there is provided pivotally mounted on the ski a toggle lever 46 pivoted to the ski by an appropriate pin 47, and having a depending member 48 provided with a slot 49 adapted to slidably engage a pin 51 mounted on the slidable rack 42 as illustrated in FIG. 13. Thus, as the toggle 46 is pivoted from one position to another, the slotted member 48 is pivoted in a manner to impose a displacement force on the pin 51, causing the slidable rack 42 to move in one direction or the other.

Figure 14:
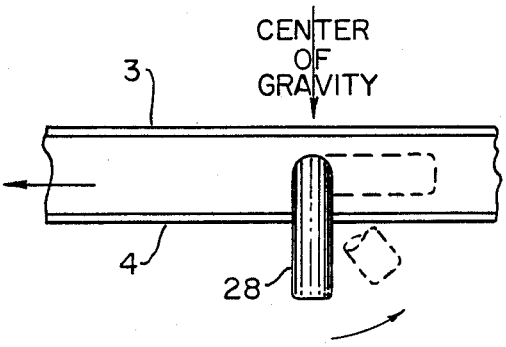
FIG. 14 is a fragmentary elevational view of one side edge illustrating the various positions to which the probes may be adjusted.

To provide a measure of adjustability of the degree of rotation of the axle 19 so as to set the depth of penetration of the probes to some degree between full penetration and complete retraction, there is provided on the skis a rotatable thumb nut 52 appropriately threaded to engage a nut 53 disposed within the ski below the top surface thereof, and adapted to move up and down as indicated by the arrow depending upon the direction and degree of rotation of the thumb nut 52. A projecting tongue 54 on the nut 53 engages a tongue 56 on the toggle 46 to limit the degree of pivotal rotation of the toggle 46 to thus permit setting of the probe angles to something less than 90 degrees to the running surface 4 of the ski. This alternate position is illustrated in FIG. 14 where it is shown that the probe 26 may be set at full depth penetration when it is set at a 90 degree angle to the running surface 4 of the ski or, alternatively, may be set at approximately 45 degrees as illustrated in broken lines, or may be retracted completely, also as shown by the broken lines. In the operation of the actuating mechanism 41, the detent structure works identically as previously described.

Figure 15:
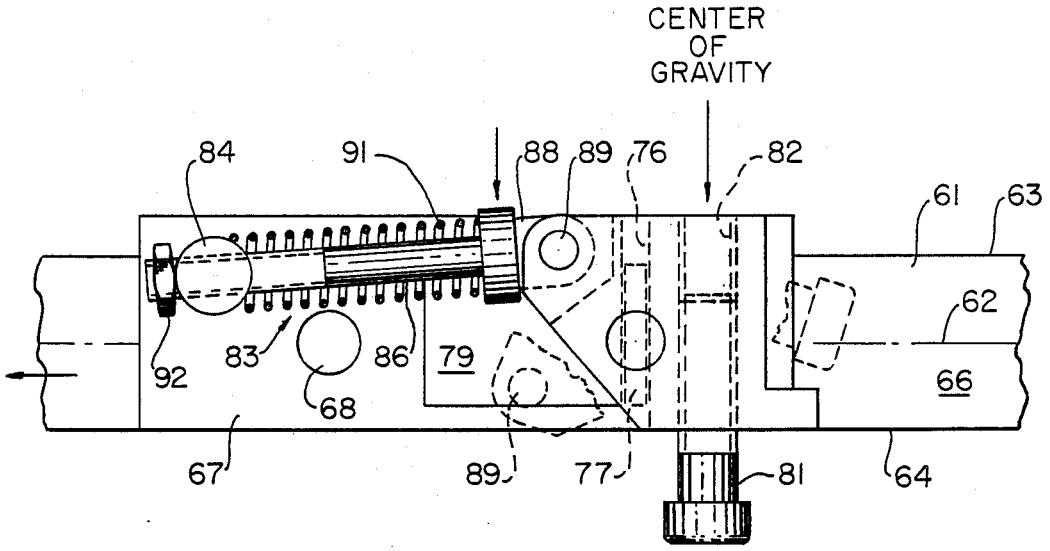
FIG. 15 is a fragmentary side elevational view of a second embodiment of the invention adapted for "integral" incorporation or retro-fit on a ski after manufacture of the ski.
Figure 16:
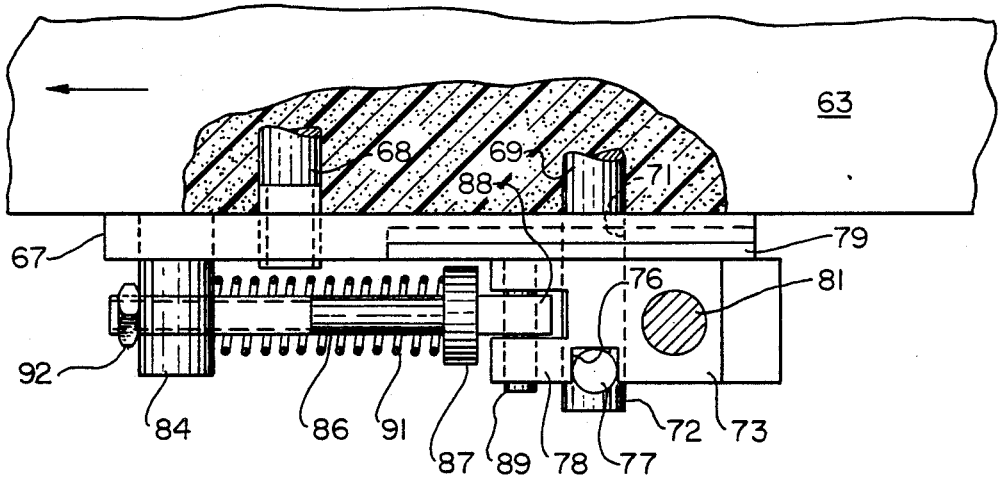
FIG. 16 is a fragmentary plan view of the embodiment of the invention illustrated in FIG. 15.

While the embodiments illustrated in FIGS. 1 through 14 relate to a probe assembly that is assembled and incorporated into a ski by the ski manufacturer, it is clear that there are instances in which owners of skis not so equipped with the probe assembly would want to equip their skis with such an assembly, and it is for this purpose that I have provided the embodiment of the invention as illustrated in FIGS. 15 and 16. Referring to FIG. 15, there is there shown a ski 61 having a longitudinal axis 62, a top surface 63 and a bottom surface 64. The ski is manufactured as described above, to have top and bottom surfaces formed from an appropriate aluminum alloy with a body of filler material disposed and laminated between the top and bottom surface members, the side edges 66 of the ski constituting a layer of tough synthetic resinous material disposed between the top and bottom surface layers as previously discussed.

Mounted on each ski are a pair of side plates 67 which are mirror images of each other, and only one of which is illustrated in FIGS. 15 and 16 in the interest of brevity in this description. The side plates 67 are conveniently fabricated from an appropriate metal, such as an aluminum alloy, but may be fabricated from other suitable material such as stainless steel. The two side plates 67 are bound to the opposing side edges 66 by means of a threaded rod 68 that extends transversely through the ski medianly between the top and bottom surfaces 63 and 64, and in a manner to intersect the longitudinal center line 62 of the ski. Each of the side plates 67 is appropriately bored as shown, and the bore threaded to be engaged by the threaded end portion of the rod 68 that projects through the side edge 66 as illustrated.

A second rod 69 also extends transversely through the ski from one side to the other, and passes through a journal bore 71 formed in the mounting plate 67 to provide a smooth outer end portion 72 on opposite sides of the ski on which are mounted a pair of mounting blocks 73 formed with a lip 74 and a slot 76 extending vertically in one side of the block, and adapted to accomodate an elongated pin 77 lying in the slot 76 and passing through the end portion 72 of the shaft 69 to retain the mounting block on the shaft. The block 73 is also provided with a bifurcated extension 78 for purposes which will hereinafter be explained.

To provide a smooth bearing surface against which the mounting block 73 may abut, the mounting plate 67 is provided with a bearing pad 79 of some appropriate synthetic resinous material that provides the low friction characteristic desired in the bearing pads 79. Mounted on each of the mounting blocks 73 is a probe 81, conveniently from $\frac{1}{8}''$ diameter to approximately $\frac{1}{4}''$ in diameter, and appropriately threaded as illustrated to threadably engage a complementarily threaded bore 82 formed in the mounting block 73 as shown. The threaded interconnection between each probe 81 and the mounting block 73 with which it is associated enables each probe to be adjusted in terms of the extent of projection from the block on which it is mounted, and to thereby adjust the depth of penetration of the probe in the snow over which the ski moves.

Mounted on the plate 67 is a spring pressed toggle arrangement designated generally by the numeral 83 and including a pivot bearing 84 rotatably mounted on the mounting plate 67 and through which passes a threaded spindle 86 having an abutment 87 at its end adjacent the bifurcated portion 78 of the mounting block 73, and an apertured lug 88 pivotally connected to the bifurcated projection 78 by an appropriate pin 89. Mounted on the spindle 86 between the pivot block 84 and the abutment block 87 is a coil compression spring 91. Mounted on the end of the threaded spindle 86 is an adjustment nut 92 which upon rotation may shorten or lengthen the effective length of the threaded spindle 86 to effectively adjust the angular position of the probe 81 in relation to the lower running surface 64 of the ski.

Thus, by turning the adjustment nut 92 clockwise, the spring 91 is compressed, the abutment 87 is pulled toward the pivot block 84, and the pin 89 is pulled counter-clockwise about the pivot point 72. In so doing, the probe 81 moves to the right as viewed in FIG. 1, thus diminishing the angle of the probe in relation to the lower surface 64 to something less than 90 degree. If it is desired to completely retract the probe 81 from projecting below the lower running surface 64 of the ski, all that is required is that a downward pressure be applied on the abutment 87 as indicated by the arrow so as to shift the position of the toggle to reposition the bifurcated portion 78 to the disengaged alternate position as illustrated in broken lines in FIG. 15. When this occurs, the probes 81 will be shifted to their position in which they lie substantially adjacent the side surfaces 66 of the ski as shown in broken lines in FIG. 15.

Two additional advantages flow from this "add on" embodiment of the invention besides the fact that it may be added to an after manufacture ski. One of those advantages is that it provides a range of flexibility as to the position along the longitudinal axis of the ski at which the assembly may be mounted. Thus, since the most advantageous position to mount the probe assembly is in such position that the probes 81 will be very close to or at the center of gravity for the particular ski-skier combination, and since this position will shift depending upon various parameters, including the weight of the skier, the length of the skis, the type of skis being used, and various other factors, it will be seen that being able to select the position along the longitudinal axis of the ski at which the probe assembly is mounted is a distinct advantage.

Another advantage that flows from this construction is that the tension in the spring 91 may be adjusted by adjustment of the nut 92 to thus vary the force that is required to be imposed against the deployed probes 81 that will cause them to be resiliently disengaged during a downhill run. For instance, with the probes deployed as illustrated in FIG. 15, i.e., at right angles to the running surface 64 of the ski, the force of the snow acting on the forward arcuate surfaces of the probes will tend to rotate the mounting blocks counter clockwise about the pivot pin 72. However, such rotation will be resisted resiliently by the coil compression spring 91, thus resiliently absorbing variations in such force that might be applied in a downhill run and thus "smooth" the run so that it is more enjoyable.

Having thus described the invention, what is believed to be new and novel, and sought to be protected by Letters Patent of the United States is as follows.

I claim:

1. In combination, a snow ski having an elongated body defined by an upper skier-support surface and a lower snow-engaging running surface defined by lateral side edge surfaces and having ski boot attachment means including a toe-piece fixed on the upper skier-support surface, and an integral probe assembly mounted on said ski and including a pair of control surfaces disposed adjacent opposite side edge surfaces and selectively deployable to engage the snow to thereby enable the skier through execution of conventional body movements to impart auxiliary control forces on said ski when it moves in relation to the snow to provide enhanced control over drag and enhanced maneuverability, said integral probe assembly including:

(a) an axle rod extending transversely through said ski between said upper and lower surfaces and having end portions terminating adjacent said lateral side edge surfaces;

(b) probe members mounted on the opposite end portions of said axle rod adjacent said lateral side edges in the vicinity of said toe piece and selectively rotationally adjustable between a retracted position in which the probe members are out of contact with the snow when the ski is in use and a deployed position in which the probe members project below the lower running surface of the ski and penetrate the snow in which the ski moves; and (c) means associated with said axis rod and forming a part of said integral probe assembly for retaining the probe members in selected position;

(d) said probe members extending transverse to said axle rod whereby selective rotational adjustment of the probe members about the axis of the axle rod varies the angle of cant of said probe members in relation to said lower running surface of the ski to thereby control the depth of penetration of the snow by said probes.

2. The combination according to claim 1, in which said probe members each include an arcuate surface adapted to impact with the snow when said probe members are deployed and said ski moves over the snow.

3. The combination according to claim 1, in which said axle rod comprises two elongated rods connected end-to-end, a bearing block mounted in said ski between said upper and lower surfaces and fixedly surrounding the interconnected ends of said two elongated rods whereby said bearing block and said axle rod are rotatable in unison about the longitudinal axis of said axle rod.

4. The combination according to claim 1, in which said means associated with said axle rod for retaining the probe members in a selected position includes a bearing block rotatably mounted within said ski between said upper and lower surfaces and axially aligned with and fixed to said axle rod and having a detent recess formed therein, a detent ball adapted to selectively engage or disengage said detent recess, and a spring resiliently biasing said detent ball in a direction to engage said detent recess.

5. The combination according to claim 1, in which said axle rod is provided with a probe member holder at each opposite end, and a probe member is adjustably mounted in each said holder whereby the degree of projection of said probe member beyond the lower running surface of the ski may be set to vary the drag coefficient of the probe in the snow.

6. The combination according to claim 5, in which a pair of support plates are fixed to opposite side edges of said ski, said axle rod includes end portions journaled on said pair of support plates, said probe member holders are mounted on said axle rod end portions for pivotal movement about the longitudinal axis of said axle rod, and said means for retaining the probe members in a selected position includes a spring-pressed toggle assembly mounted on each said support plate whereby actuation of the toggle assembly in one direction effects deployment of the probe assembly to project into the snow and actuation of the toggle assembly in the opposite directiuon effects retraction of the probe members so as to not engage with the snow when the ski is in use.

7. The combination according to claim 6, in which means are provided on said toggle assembly for adjusting the degree of cant of said probe members in relation to the lower running surface of said ski.

* * * * *